US005941214A

United States Patent [19]

Hoffmann et al.

[11] Patent Number: 5,941,214

[45] Date of Patent: Aug. 24, 1999

[54] DEVICE AND METHOD FOR REGULATING THE FUEL PRESSURE IN A HIGH-PRESSURE ACCUMULATOR

[75] Inventors: Christian Hoffmann, Regensburg; Wendelin Klügl, Seubersdorf; Andreas Hartke, Regensburg, all of Germany

[73] Assignee: Siemens Aktiengesellschaft, Munich, Germany

[21] Appl. No.: 09/005,699

[22] Filed: Jan. 12, 1998

Related U.S. Application Data

[63] Continuation of application No. PCT/DE97/00902, May 2, 1997.

[51] Int. Cl.[6] ..... F02M 37/04

[52] U.S. Cl. ..... 123/456; 123/447

[58] Field of Search ..... 123/447, 446, 123/456, 497, 514

[56] References Cited

U.S. PATENT DOCUMENTS

| | | | |
|---|---|---|---|
| 3,587,547 | 6/1971 | Hussey | 123/447 |
| 4,541,385 | 9/1985 | Eheim | 123/447 |
| 5,284,120 | 2/1994 | Fukushima | 123/497 |
| 5,642,716 | 7/1997 | Ricco | 123/456 |
| 5,711,274 | 1/1998 | Drummer | 123/456 |
| 5,713,326 | 2/1998 | Huber | 123/447 |
| 5,758,622 | 6/1998 | Rembold | 123/456 |

FOREIGN PATENT DOCUMENTS

| | | |
|---|---|---|
| 0299337A2 | 1/1989 | European Pat. Off. . |
| 19548278A1 | 6/1997 | Germany . |

OTHER PUBLICATIONS

Japanese Patent Abstract No. 07083137 (Kiyouya et al.), dated Mar. 28, 1995.

Japanese Patent Abstract No. 03043643 (Masaru et al.), dated Feb. 25, 1991.

*Primary Examiner*—Carl S. Miller

*Attorney, Agent, or Firm*—Herbert L. Lerner; Laurence A. Greenberg

[57] ABSTRACT

A device and a method are provided for regulating the fuel pressure in a high-pressure accumulator. A volumetric flow regulation and a pressure regulation combine the advantages of regulation of volumetric flow and regulation of pressure with one another and thus achieve increased dynamics and higher efficiency.

10 Claims, 2 Drawing Sheets

DEVICE AND METHOD FOR REGULATING THE FUEL PRESSURE IN A HIGH-PRESSURE ACCUMULATOR

CROSS-REFERENCE TO RELATED APPLICATION

This application is a continuation of International application Ser. No. PCT/DE97/00902, filed May 2, 1997, which designated the United States.

BACKGROUND OF THE INVENTION

FIELD OF THE INVENTION

The invention relates to a device for regulating the fuel pressure in a high-pressure accumulator, including a controller for a volumetric flow in an inflow to a high-pressure pump connected to the high-pressure accumulator, and a pressure sensor assigned to the high-pressure accumulator and signaling the fuel pressure in the high-pressure accumulator to the controller. The invention also relates to a method for regulating the fuel pressure in a high-pressure accumulator for fuel, which includes supplying fuel to the high-pressure accumulator through a high-pressure pump, discharging fuel from the high-pressure accumulator through an injection system, and regulating the volumetric flow of fuel upstream of the high-pressure pump in a low-pressure region as a function of the pressure in the high-pressure accumulator.

High-pressure accumulators for fuel are used in common-rail injection systems. In that case, fuel is pumped into a high-pressure accumulator by a high-pressure pump, and the fuel is supplied to individual injection nozzles from the high-pressure accumulator. That makes it possible to have a high injection pressure which reduces the emission of particles, particularly in diesel injection.

Published European Patent Application 0 299 337 A2, corresponding to U.S. Pat. No. 4,884,545, has already disclosed a device for regulating the fuel pressure in a high-pressure accumulator as well as a method for regulating the fuel pressure in a high-pressure accumulator. In that case, fuel is supplied by a pre-feed pump, through a controllable throttle, to a high-pressure pump which pumps the fuel into the high-pressure accumulator at high pressure. The high-pressure accumulator conducts the fuel further to the injection nozzles and has a safety pressure valve which connects the high-pressure accumulator to the fuel tank when the maximum pressure is exceeded. The controllable throttle is activated by a control unit as a function of operating parameters of the internal combustion engine, so that a regulation of volumetric flow is carried out on the low-pressure side.

The disadvantage of the device and the method described in the prior art is that a reduction of pressure in the high-pressure accumulator can take place only relatively slowly, since the controllable throttle cannot be used for pressure reduction.

SUMMARY OF THE INVENTION

It is accordingly an object of the invention to provide a device and a method for regulating the fuel pressure in a high-pressure accumulator, which overcome the hereinafore-mentioned disadvantages of the heretofore-known devices and methods of this general type, which allow a rapid pressure reduction and which moreover have high efficiency.

With the foregoing and other objects in view there is provided, in accordance with the invention, a device for regulating the fuel pressure in a high-pressure accumulator, comprising a high-pressure pump connected to a high-pressure accumulator having a fuel pressure to be regulated, the high-pressure pump having an inflow; a first controller having a continuous control behavior for controlling a volumetric flow in the inflow to the high-pressure pump; a second controller having a step-by-step control behavior for controlling the fuel pressure in the high-pressure accumulator; and a first pressure sensor associated with the high-pressure accumulator, the first pressure sensor reporting the fuel pressure in the high-pressure accumulator to the first controller, and the first pressure sensor reporting the fuel pressure in the high-pressure accumulator to the second controller.

In accordance with another feature of the invention, the first controller has an input, and the second controller has an output fed to the input of the first controller.

In accordance with a further feature of the invention, there is provided a controllable feed pump for regulating the volumetric flow in the inflow to the high-pressure pump.

In accordance with an added feature of the invention, there is provided a constant throttle disposed downstream of the controllable feed pump.

In accordance with an additional feature of the invention, in addition to or instead of the first pressure sensor, there is provided a second pressure sensor disposed upstream of the high-pressure pump; and a measuring line connecting the pressure sensor to the first controller.

With the objects of the invention in view, there is also provided a method for regulating the pressure in a high-pressure accumulator for fuel, which comprises supplying fuel through a high-pressure pump to a high-pressure accumulator; discharging fuel from the high-pressure accumulator through an injection system; regulating a volumetric flow of fuel in a low-pressure region upstream of the high-pressure pump as a function of the pressure in the high-pressure accumulator; regulating the pressure in the high-pressure accumulator in a high-pressure region as a function of the pressure in the high-pressure accumulator; regulating the volumetric flow of fuel in the low-pressure region when the pressure in the high-pressure accumulator is lower than a trigger pressure; and regulating the pressure in the high-pressure accumulator when the pressure in the high-pressure accumulator is higher than the trigger pressure.

In accordance with another mode of the invention, there is provided a method which comprises regulating the volumetric flow when the pressure in the high-pressure accumulator exceeds the trigger pressure.

In accordance with a further mode of the invention, there is provided a method which comprises regulating the volumetric flow as a function of the pressure regulation.

In accordance with a concomitant mode of the invention, there is provided a method which comprises ascertaining the trigger pressure from a sum of a desired value and a threshold value.

The device and the method according to the invention afford the advantage of carrying out quasi-stationary changes in the fuel pressure by a regulation of volumetric flow on the low-pressure side and carrying out dynamic changes in the fuel pressure by pressure regulation on the high-pressure side. In this way, the advantage of the high efficiency of a regulation of volumetric flow on the low-pressure side, combined with the advantage of the high dynamics of pressure regulation on the high-pressure side and improved dynamics, with an efficiency higher than that of pressure regulation on the high-pressure side, are thereby achieved.

Other features which are considered as characteristic for the invention are set forth in the appended claims.

Although the invention is illustrated and described herein as embodied in a device as well as a method for regulating the fuel pressure in a high-pressure accumulator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
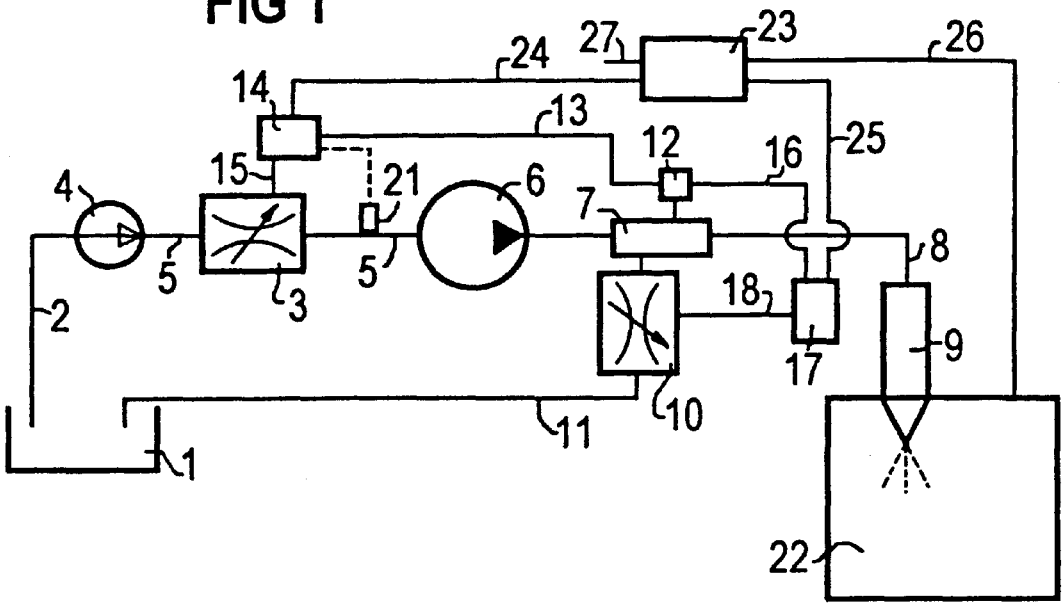
FIG. 1 is a block circuit diagram of a high-pressure accumulator with a preceding volumetric flow regulating valve.

Referring now to the figures of the drawings in detail and first, particularly, to FIG. 1 thereof, there is seen a tank 1 which is connected through a fuel inlet line 2 to a feed pump 4. The feed pump 4, which is not controllable, is connected through a feed line 5 and a regulating valve 3 to a high-pressure pump 6. An outlet of the high-pressure pump 6 is connected to a high-pressure accumulator (common-rail) 7. The high-pressure accumulator 7 has an injection line 8 which is led to an injector 9 of an internal combustion engine 22. The high-pressure accumulator 7 is connected through a pressure-regulating valve 10 and a fuel return line 11 to the tank 1.

Furthermore, a pressure sensor 12 is disposed at the high-pressure accumulator 7. The pressure sensor 12 is connected through a first measuring line 13 to a first controller 14 which is connected through a first control line 15 to the regulating valve 3. Moreover, the pressure sensor 12 is connected through a second measuring line 16 to a second controller 17 which is connected through a second control line 18 to the pressure-regulating valve 10.

The first controller 14 and the second controller 17 are respectively connected through a first data line 24 and a second data line 25 to a computing unit 23, which is moreover connected through a third measuring line 26 to the internal combustion engine 22. Furthermore, the computing unit 23 has input lines 27, through which various input values, such as an accelerator pedal position of the motor vehicle, for example, are received. Instead of the pressure sensor 12, according to a development of the invention, a second pressure sensor 21 may be used for feeding the first controller 14. The second pressure sensor 21 is disposed in the feed line 5 upstream of the low-pressure side of the high-pressure pump 6 and is connected to the first controller 14. The regulating valve 3 can thus also be regulated according to the pressure in the feed line 5.

Figure 2:
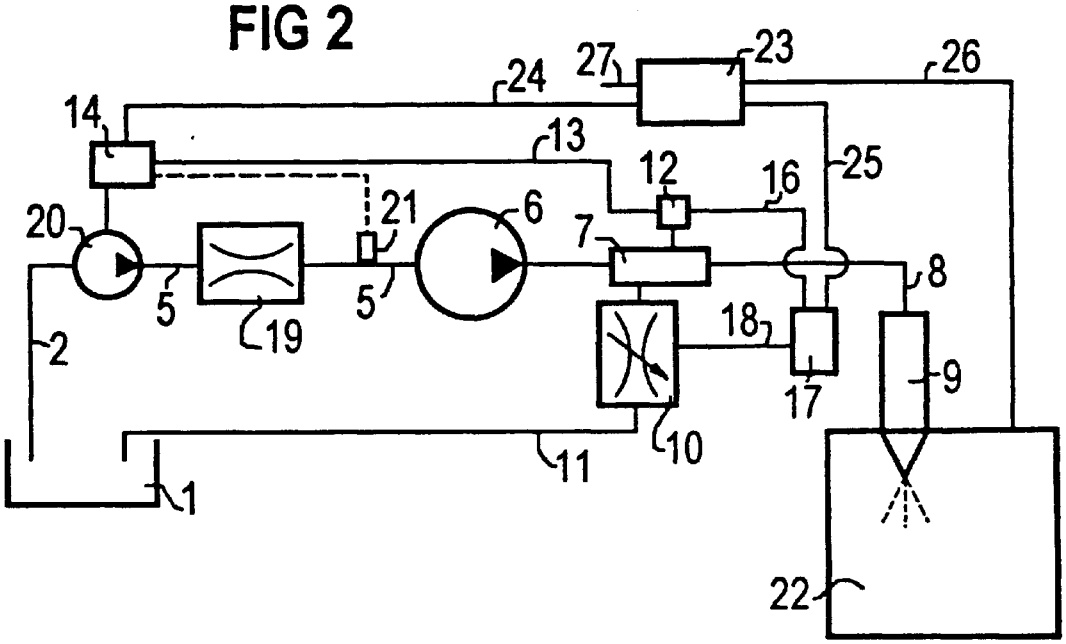
FIG. 2 is a block circuit diagram of a high-pressure accumulator with a preceding controllable feed pump.

FIG. 2 shows a configuration corresponding to that of FIG. 1, but in which a controllable feed pump 20 is provided instead of the non-controllable feed pump 4. The controllable feed pump 20 is controlled through the first control line 15 by the first controller 14. A further difference is that the regulating valve 3 is dispensed with and a constant throttle 19 is inserted between the controllable feed pump 20 and the high-pressure pump 6, instead of the regulating valve 3. The configuration of FIG. 2 corresponds in other details to the configuration of FIG. 1, with identical parts being provided with the same reference symbols.

According to a development of the invention shown in FIG. 2, a second pressure sensor 21 for feeding the first controller 14 is used instead of the pressure sensor 12. The second pressure sensor is disposed in the feed line 5 upstream of the low-pressure side of the high-pressure pump 6 and is connected to the first controller 14.

The controllable feed pump 20 can thus also be regulated according to the pressure in the feed line 5.

Figure 3:
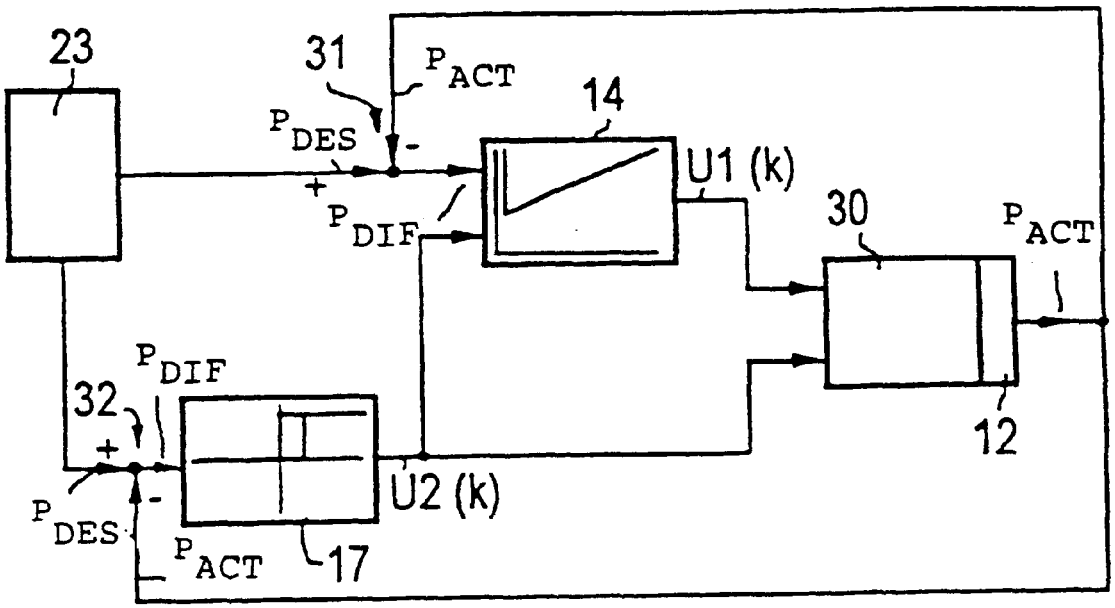
FIG. 3 is a block circuit diagram with a diagrammatic illustration of a regulating method.

FIG. 3 shows a diagrammatic illustration of the regulating method according to the invention. A desired pressure $P_{DES}$ is predetermined for the high-pressure accumulator according to the operating state of the internal combustion engine 22. In the following example, it is assumed, on the basis of the operating state of the internal combustion engine 22, which includes, for example, the engine speed, the load and the exhaust-gas values, and using the input data supplied by the input lines 27, such as the position of the accelerator pedal, for example, that the computing unit 23 ascertains the desired pressure $P_{DES}$ for the high-pressure accumulator 7 and predetermines it for a first comparator 31 and a second comparator 32.

The pressure sensor 12 likewise transmits the current actual pressure of the high-pressure accumulator 7 to the first comparator 31 and to the second comparator 32 as an actual pressure $P_{ACT}$. The first comparator 31 and the second comparator 32 subtract the actual pressure from the desired pressure and ascertain therefrom a differential pressure $P_{DIF}$: $P_{DES}-P_{ACT}=P_{DIF}$.

The differential pressure $P_{DIF}$ is transmitted from the first comparator 31 to the first controller 14, which activates the regulating valve 3 in the embodiment of FIG. 1 or the controllable feed pump 20 in the embodiment of FIG. 2. The differential pressure $P_{DIF}$ is also transmitted from the second comparator 32 to the second controller 17, which activates the pressure-regulating valve 10. The first controller 14 is preferably constructed as a PID controller which calculates a current first controller action u1(k) from the differential pressure $P_{DIF}$, which is designated as a current control deviation e(k) for the following formula. The calculation is carried out according to the following rule:

$$u1(k) = u1(k-1) = K\left[\left(1+\frac{T_D}{T_0}\right)e(k) - \left(1+2\frac{T_D}{T_0}-\frac{T_0}{T_1}\right)e(k-1) + \frac{T_D}{T_0}e(k-2)\right]$$

in which:

u1(k) denotes the current controller action, u1(k-1) denotes the last controller action, e(k) denotes the current control deviation, e(k-1) denotes the next to the last control deviation, K denotes the amplification factor, $T_0$ denotes the sampling time, $T_D$ denotes the differentiating time, and $T_I$ denotes the integrating time.

In this case, preferably the amplification factor K is 0.2%/M pascal, the sampling time $T_0$ is 20 msec, the differentiating time $T_D$ is 10 msec and the integrating time $T_I$ is 70 msec. The second controller 17 is preferably constructed as a two-position controller which calculates a current second controller action u2(k) according to the following rule:

$$u2(k) = \frac{T_e}{T_z} Ky$$

in which:

y denotes the stationary final value of the desired quantity with the controller at the upper switching point, K denotes the amplification factor, $T_z$ denotes the period duration, and $T_e$ denotes the duty cycle.

In a preferred embodiment of the invention, the stationary final value is 60 M pascal, the amplification factor K is 0.045%/M pascal, the period duration $T_z$ is 2 msec and the duty cycle is 1 msec.

In the exemplary embodiment described herein, the two-position controller 17 switches from its zero value to the current controller action u2(k) when $P_{DIF}$ is above a predetermined value which is preferably 100 bar.

In a preferred embodiment, the current controller action u2(k) of the two-position controller 17 is transmitted to the first controller 14 which corrects the current controller action of the first controller 14 or stops the regulation, as a function of the current controller action u2(k) of the second controller 17.

The current controller actions of the first controller 14 and of the second controller 17 are supplied to a controlled system 30. The pressure sensor 12 and/or the second pressure sensor 21 ascertain the pressure in the high-pressure accumulator or upstream of the high-pressure accumulator and transmit the pressure to the first comparator 31 and to the second comparator 32 as the actual pressure $P_{ACT}$. As is evident from FIG. 1, the first controller 14 transmits the current first controller action to the regulating valve 3 and the second controller 17 transmits the current second controller action to the pressure valve 10. According to a further embodiment of the invention, the first controller 14 regulates the controllable feed pump 20 through the use of the current first controller action, as is illustrated in FIG. 2.

The first and the second controllers 14, 17 are selectively constructed as analog or digital controllers.

We claim:

1. A device for regulating the fuel pressure in a high-pressure accumulator, comprising:

a high-pressure pump connected to a high-pressure accumulator having a fuel pressure to be regulated, said high-pressure pump having an inflow;

a first controller having a continuous control behavior for controlling a volumetric flow in said inflow to said high-pressure pump;

a second controller having a step-by-step control behavior for controlling the fuel pressure in the high-pressure accumulator; and a pressure sensor associated with the high-pressure accumulator, said pressure sensor reporting the fuel pressure in the high-pressure accumulator to said first controller, and said pressure sensor reporting the fuel pressure in the high-pressure accumulator to said second controller.

2. The device according to claim 1, wherein said first controller has an input, and said second controller has an output fed to the input of said first controller.

3. The device according to claim 1, including a controllable feed pump for regulating the volumetric flow in said inflow to said high-pressure pump.

4. The device according to claim 3, including a constant throttle disposed downstream of said controllable feed pump.

5. The device according to claim 1, including another pressure sensor disposed upstream of said high-pressure pump; and a measuring line connecting said pressure sensor to said first controller.

6. A device for regulating the fuel pressure in a high-pressure accumulator, comprising:

a high-pressure pump connected to a high-pressure accumulator having a fuel pressure to be regulated, said high-pressure pump having an inflow;

a first controller having a continuous control behavior for controlling a volumetric flow in said inflow to said high-pressure pump;

a second controller having a step-by-step control behavior for controlling the fuel pressure in the high-pressure accumulator;

a pressure sensor disposed upstream of said high-pressure pump; and a measuring line connecting said pressure sensor to said first controller.

7. A method for regulating the pressure in a high-pressure accumulator for fuel, which comprises:

supplying fuel through a high-pressure pump to a high-pressure accumulator;

discharging fuel from the high-pressure accumulator through an injection system;

regulating a volumetric flow of fuel in a low-pressure region upstream of the high-pressure pump as a function of the pressure in the high-pressure accumulator;

regulating the pressure in the high-pressure accumulator in a high-pressure region as a function of the pressure in the high-pressure accumulator;

regulating the volumetric flow of fuel in the low-pressure region when the pressure in the high-pressure accumulator is lower than a trigger pressure; and regulating the pressure in the high-pressure accumulator when the pressure in the high-pressure accumulator is higher than the trigger pressure.

8. The method according to claim 7, which comprises regulating the volumetric flow when the pressure in the high-pressure accumulator exceeds the trigger pressure.

9. The method according to claim 7, which comprises regulating the volumetric flow as a function of the pressure regulation.

10. The method according to claim 7, which comprises ascertaining the trigger pressure from a sum of a desired value and a threshold value.

* * * * *

UNITED STATES PATENT AND TRADEMARK OFFICE

CERTIFICATE OF CORRECTION

PATENT NO : 5,941,214

DATED : August 24, 1999

INVENTOR(S) : Christian Hoffmann et al.

It is certified that error appears in the above-identified patent and that said Letters Patent is hereby corrected as shown below:

On the title page:

Item [30] should read as follows:

May 10, 1996 [DE] Germany ..... 196 18 932.2

Signed and Sealed this
First Day of February, 2000

*Attest:*

Q. TODD DICKINSON

*Attesting Officer*

*Acting Commissioner of Patents and Trademarks*